US006535082B2

(12) United States Patent
Kuroda et al.

(10) Patent No.: US 6,535,082 B2
(45) Date of Patent: Mar. 18, 2003

(54) DIELECTRIC FILTER, DIELECTRIC DUPLEXER, AND COMMUNICATION DEVICE USING THE SAME

(75) Inventors: Katsuhito Kuroda, Matto (JP); Jinsei Ishihara, Kanazawa (JP); Hideyuki Kato, Ishikawa-ken (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 09/915,431

(22) Filed: Jul. 26, 2001

(65) Prior Publication Data

US 2002/0021189 A1 Feb. 21, 2002

(30) Foreign Application Priority Data

Aug. 10, 2000 (JP) ..... 2000-243301

(51) Int. Cl.[7] ..... H01P 1/20
(52) U.S. Cl. ..... 333/202; 333/206; 333/134
(58) Field of Search ..... 333/134, 202, 333/206

(56) References Cited

U.S. PATENT DOCUMENTS 4,742,562 A * 5/1988 Kommrusch ..... 455/78
5,278,527 A * 1/1994 Kenoun et al. ..... 333/202
5,344,695 A * 9/1994 Hirai et al. ..... 428/209
5,742,214 A * 4/1998 Toda et al. ..... 333/202
5,818,312 A * 10/1998 Noguchi et al. ..... 333/202
5,886,986 A * 3/1999 Lee et al. ..... 370/276
6,052,040 A * 4/2000 Hino ..... 333/134
6,154,951 A * 12/2000 Ito et al. ..... 29/600

FOREIGN PATENT DOCUMENTS

JP 5145302 6/1993

* cited by examiner

*Primary Examiner*—Michael Tokar
*Assistant Examiner*—Linh Van Nguyen
(74) *Attorney, Agent, or Firm*—Dickstein, Shapiro, Morin & Oshinsky LLP.

(57) ABSTRACT

A dielectric filter includes a dielectric block having substantially a rectangular parallelepiped shape, a plurality of internal-conductor-formed holes provided substantially parallel to one another in the dielectric block, each including an internal conductor formed on the internal surface thereof, an external conductor formed on the external surface of the dielectric block, and an input/output electrode formed on the external surface of the dielectric block. In the dielectric filter, the input/output electrode is formed from a side face, which is an end face of the dielectric block in a parallel direction of the internal-conductor-formed holes, to a bottom face, which is a mounting face of the dielectric block facing a mounting substrate, a capacitance is generated between the internal conductor of a first internal-conductor-formed hole closest to the end face and the internal conductor of a second internal-conductor-formed hole in the neighborhood of the first internal-conductor-formed hole, and the cross section of at least the first internal-conductor-formed hole is a noncircular shape extending in a direction parallel to the side face.

11 Claims, 6 Drawing Sheets

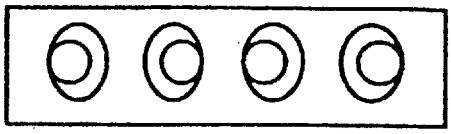
FIG. 3A
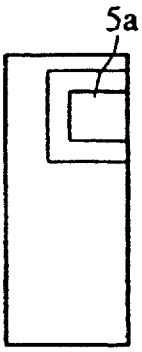
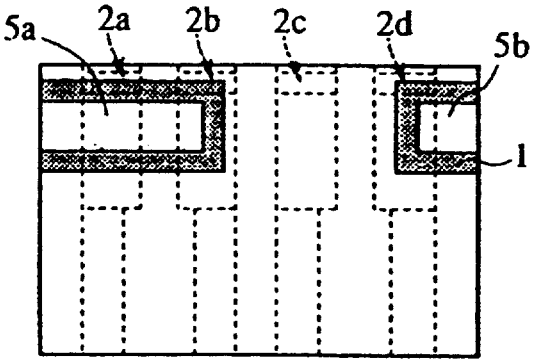
FIG. 3B
FIG. 3C
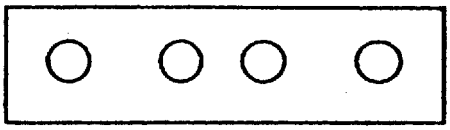
FIG. 3D
FIG. 4
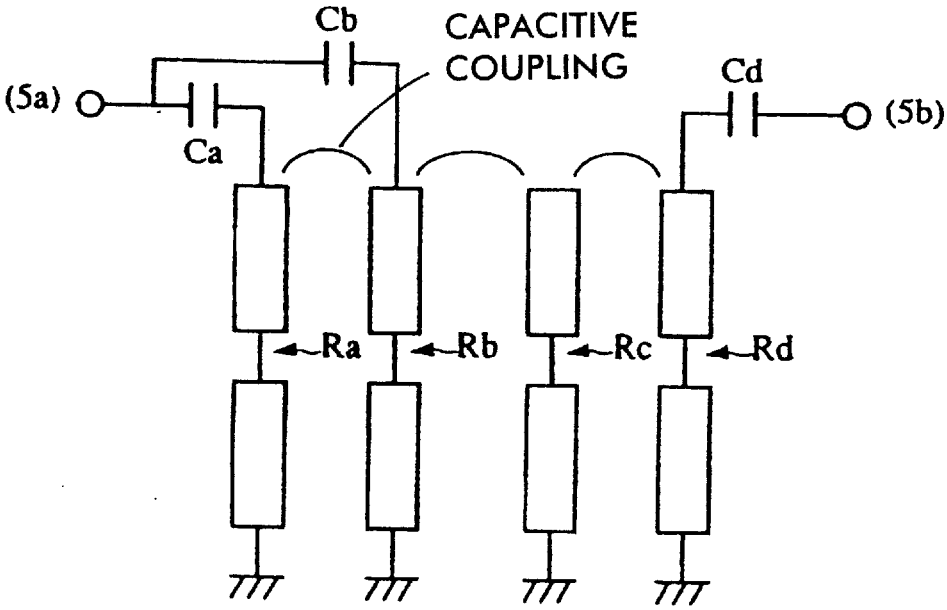

FIG. 5
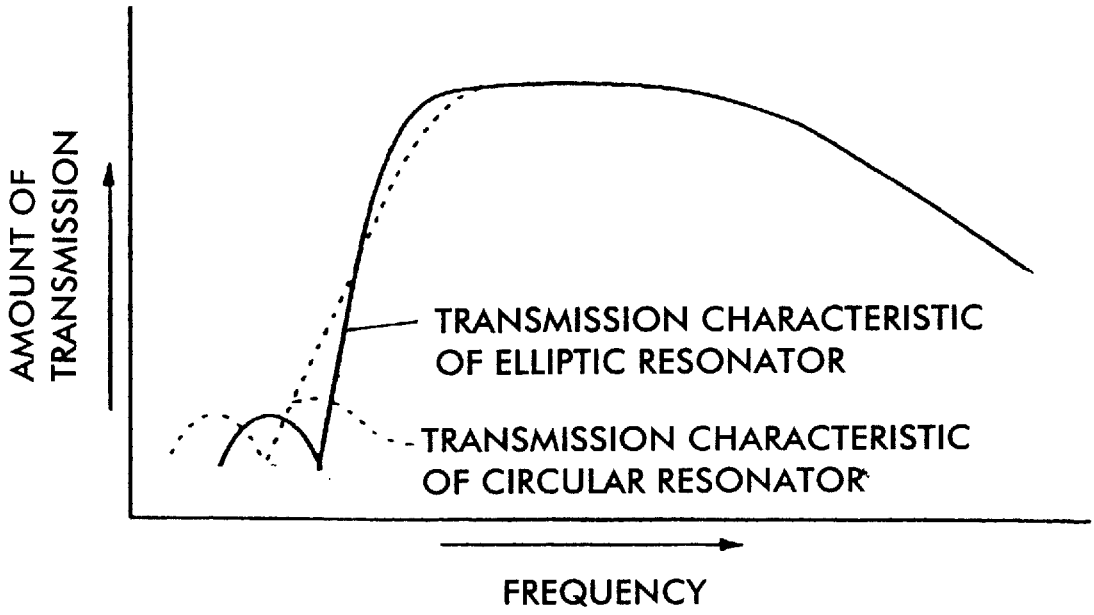
FIG. 6C
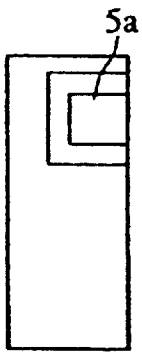
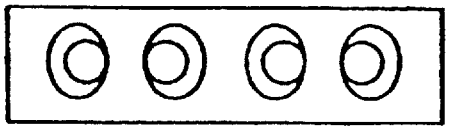
FIG. 6A
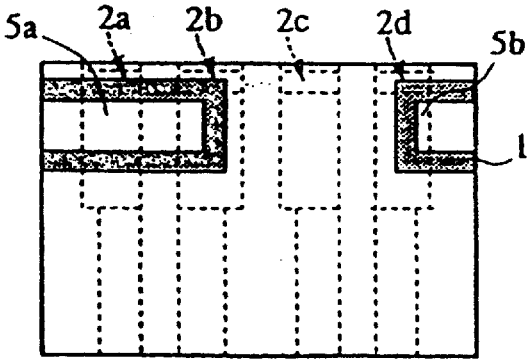
FIG. 6B
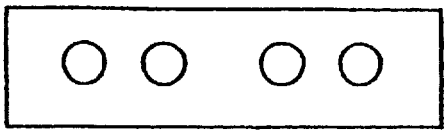
FIG. 6D

DIELECTRIC FILTER, DIELECTRIC DUPLEXER, AND COMMUNICATION DEVICE USING THE SAME

BACKGROUND OF THE INVENTION

1. Field of the Invention

The present invention relates to a dielectric filter and dielectric duplexer obtained by forming conductive films on the inside and outside of a dielectric block, and relates to a communication device using the same.

2. Description of the Related Art

Dielectric filters formed by providing a plurality of resonant transmission lines obtained by forming conductive films on the inside and outside of a dielectric block are used in communication devices such as cellular phones.

Conventional dielectric filters using the dielectric block and in which an attenuation pole is generated near a passband are disclosed in Japanese Unexamined Patent Publication No. 5-145302.

A dielectric filter disclosed in the above application has a multipath construction in which two internal conductors disposed in a dielectric block and provided with a plurality of internal-conductor-formed holes, each of which constitutes a resonant transmission line, are capacitively coupled with an input/output electrode formed on the external face of the dielectric block.

The above multipath construction produces an attenuation pole on the low-frequency side or the high-frequency side of a passband. In order to dispose this attenuation pole close to the passband, leap coupling between the second resonant transmission line from the endmost one among the plurality of internal-conductor-formed holes arranged in the conductive block and the input/output electrode should be increased.

However, when the capacitance between the second resonant transmission line from the endmost one and the input/output electrode is increased, since the capacitance (the amount of external coupling) between the first (endmost) resonant transmission line and the input/output electrode is relatively decreased, the characteristics of the passband, in particular a reflection characteristic, are worsened.

When the first resonant transmission line and the input/output electrode are disposed close to each other in order to increase the external coupling therebetween, a problem arises in that since the electric field intensity is increased, the insertion loss is worsened.

SUMMARY OF THE INVENTION

Accordingly, objects of the present invention are to provide a dielectric filter and dielectric duplexer in which the attenuation pole is disposed close to the passband without degrading the characteristics of the passband and without increasing the insertion loss and to provide a communication device provided therewith.

To this end, according to a first aspect of the present invention, there is provided a dielectric filter including a dielectric block having substantially a rectangular parallelepiped shape, a plurality of internal-conductor-formed holes provided substantially parallel to one another in the dielectric block, each including an internal conductor formed on the internal surface thereof, an external conductor formed on the external surface of the dielectric block, and an input/output electrode formed on the external surface of the dielectric block. In the dielectric filter, the input/output electrode is formed from a side face, which is an end face of the dielectric block in the arrangement direction of the internal-conductor-formed holes, to a bottom face, which is a mounting face of the dielectric block facing a mounting substrate, a capacitance is generated between the internal conductor of a first internal-conductor-formed hole closest to the end face and the internal conductor of a second internal-conductor-formed hole in the neighborhood of the first internal-conductor-formed hole, and the cross section of at least the first internal-conductor-formed hole is a noncircular shape extending along the side face.

Since the electrical field intensification is reduced in an external coupling part between a resonant transmission line using the internal-conductor-formed hole closest to a side face of the dielectric block and the input/output electrode and mutual coupling between two resonant transmission lines using the internal-conductor-formed hole closest to the side face and the internal-conductor-formed hole next to it is increased, the attenuation pole can be disposed closer to the passband.

According to a second aspect of the present invention, a dielectric duplexer includes a dielectric filter according to the first aspect of the present invention. In the dielectric duplexer, the input/output electrode of the dielectric filter serves as one of a transmission signal input electrode, a reception signal output electrode, and an antenna connection electrode.

This aspect of the invention enables the dielectric duplexer to have a sufficient amount of attenuation between the transmission band and the reception band.

According to a third aspect of the present invention, a communication device includes the dielectric filter according to the first aspect of the present invention or the dielectric duplexer according to the second aspect of the present invention.

By employing a small band-pass filter having excellent in-band characteristics and having a sufficient amount of attenuation in the neighborhood of the passband, a miniaturized communication device having the excellent communication performance can be constructed.

Other features and advantages of the present invention will become apparent from the following description of the invention which refers to the accompanying drawings.

BRIEF DESCRIPTION OF THE DRAWING(S)

FIGS. 3A to 3D are projection views of the dielectric filter;

FIG. 4 is an equivalent circuit diagram of the dielectric filter;

FIG. 5 is a graph showing a transmission characteristic of the dielectric filter;

FIGS. 6A to 6D are projection views of a dielectric filter according to a second embodiment;

DETAILED DESCRIPTION OF EMBODIMENTS OF THE INVENTION

The construction of a dielectric filter according to a first embodiment is described with reference to FIGS. 1 to 5.

Figure 1:
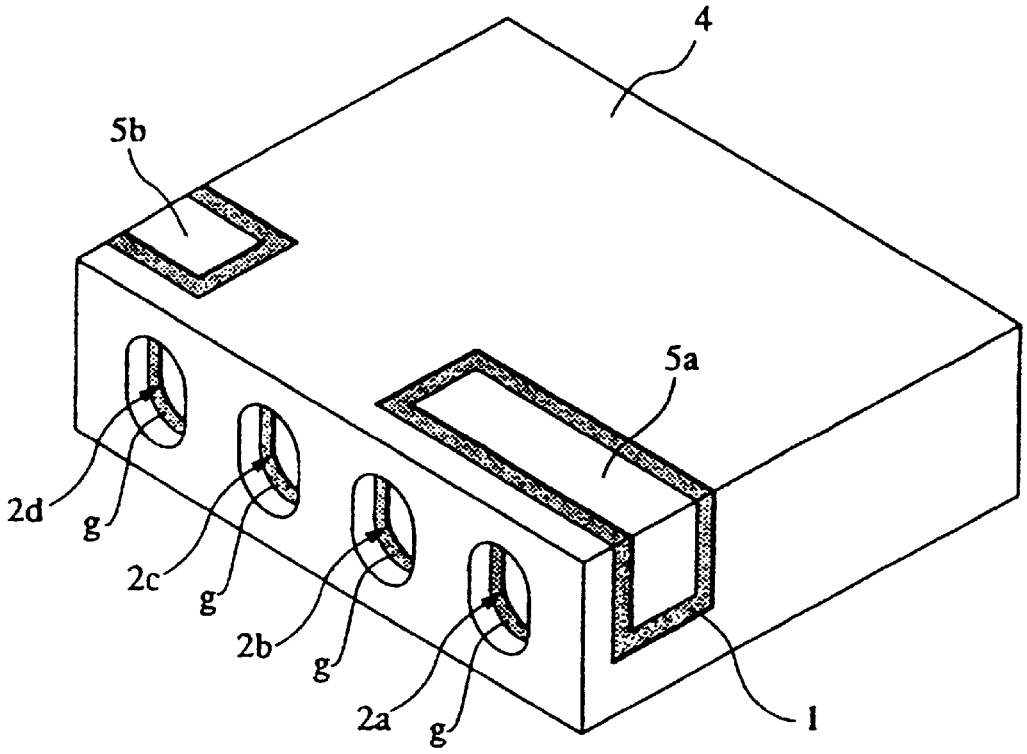
FIG. 1 is a perspective view of a dielectric filter according to a first embodiment of the present invention.
Figure 2:
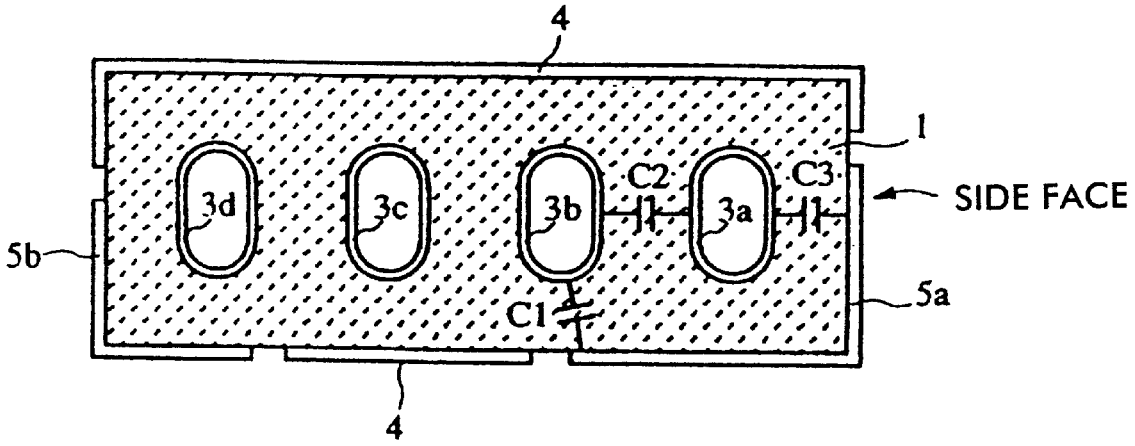
FIG. 2 is a cross sectional view of the dielectric filter.

FIG. 1 is a perspective view of the dielectric filter; FIG. 2 is a cross sectional view along a plane perpendicular to the axes of internal-conductor-formed holes 2*a*, 2*b*, 2*c* and 2*d*; and FIGS. 3A, 3B, 3C, and 3D are projection views. In FIG. 1, the face to be mounted to a mounting substrate is illustrated as the top face. As shown in these figures, four internal-conductor-formed holes 2*a*, 2*b*, 2*c*, and 2*d* which run parallel to one another are arranged inside of a dielectric block 1 having substantially a rectangular parallelepiped shape. The cross sections of these internal-conductor-formed holes 2*a*, 2*b*, 2*c* and 2*d* form elliptical shapes (ellipse). The internal conductors are individually formed as the resonant transmission line on the internal surfaces of the internal-conductor-formed holes. An external conductor 4 is formed on the external surfaces (six faces) of the dielectric block 1. Internal-conductor-non-formed parts "g"s are provided near the openings of the internal-conductor-formed holes 2*a* to 2*d* and they are caused to serve as open ends of the resonant transmission lines. Input/output electrodes 5*a* and 5*b* are provided near the open ends of the internal conductors from a side face, which is an end face in the arrangement direction of the internal-conductor-formed holes 2*a* to 2*d*, to the bottom face (the top face in FIG. 1), which is a mounting face facing the mounting substrate.

FIG. 2 illustrates capacitances generated between internal conductors and input/output electrodes. Capacitances C3 and C1 are generated between the input/output electrode 5*a* and each of the internal conductor 3*a* of the internal-conductor-formed hole which is closest to the side face of the dielectric block 1 and the internal conductor 3*b* of the internal-conductor-formed hole next to it. Capacitance C2 is generated between the internal conductors 3*a* and 3*b*. Thus, by forming the cross sections of the internal-conductor-formed holes as elliptical shapes (ellipses) extending along the side face of the dielectric block, the intensity of the electric field of a capacitance C3 part can be reduced while the capacitance C3 is increased.

This increases the capacitance of leap coupling while the amount of external coupling is ensured, which can improve the characteristics of the passband. In addition, this can decrease the insertion loss due to the electric field intensification. By entirely flattening each internal-conductor-formed hole in a direction parallel to the side face (direction perpendicular to the arrangement direction of the internal-conductor-formed holes), parts of neighboring internal-conductor-formed holes facing each other form a flat (or the curvature is decreased). Accordingly, even though the arrangement pitch of the internal-conductor-formed holes is narrowed, the electric field intensification can be prevented. This can reduce the overall size of the dielectric block in the arrangement direction of the internal-conductor-formed holes, which can make the overall miniaturized dielectric filter.

As the facing area between the internal conductors 3*a* and 3*b* increases, the mutual capacitance C2 shown in FIG. 2 can be easily increased. The attenuation pole is caused to be provided closer to the passband in accordance with the increase in the capacitance C2. This can ensure a sufficient amount of attenuation in an unwanted signal that is in the proximity of the passband.

FIG. 3A is a top view of the dielectric filter in which the dielectric filter stands and its mounting face faces forward; FIG. 3B is a front view; FIG. 3C is a left-side view; and FIG. 3D is a bottom view. Thus, a step construction is formed in which the internal diameters of the internal-conductor-formed holes 2*a* to 2*d* are larger on the open-end sides and smaller on the short-circuit end sides. The centers of the holes on the short-circuit end sides of the internal-conductor-formed holes 2*a* and 2*b* are decentered in such a direction to be further apart from each other, which capacitively couples the resonators using these two internal-conductor-formed holes. Likewise, the two resonators using the internal-conductor-formed holes 2*c* and 2*d* are capacitively coupled. The resonators using the internal-conductor-formed holes 2*b* and 2*c* are capacitively coupled by causing the centers of the holes on the short-circuit end sides to be provided relatively close to each other due to decentralization on the open-end sides.

FIG. 4 is an equivalent circuit diagram of the above dielectric filter. $R_a$ to $R_d$ are resonators using the internal-conductor-formed holes 2*a* to 2*d* shown in FIGS. 3A to 3D. $C_a$ and $C_b$ are capacitances generated between the input/output electrode 5*a* and each of the internal conductors near the open ends of the internal-conductor-formed holes 2*a* and 2*b*. $C_d$is capacitance generated between the internal conductor near the open end of the internal-conductor-formed hole 2*d* and the input/output electrode 5*b*.

FIG. 5 shows a transmission characteristic of the above dielectric filter. In this figure, a solid line indicates the characteristic of the dielectric filter, shown in FIGS. 3A to 3D, according to the present invention, and the dashed line indicates a characteristic of a case in which the cross sections of the internal-conductor-formed holes on the open-end sides are circular in the same manner as those on the short-circuit sides. Thus, by forming the cross sectional shapes of the internal-conductor-formed holes as ellipses extending along the side face of the dielectric block, Ca can be increased without increasing the electric field intensification. Accordingly, the attenuation pole can be provided close to the passband. In addition, the attenuation pole can be provided closer to the passband side by, as described above, increasing the degree of coupling between the resonators $R_a$ and $R_b$as well.

The construction of a dielectric filter according to a second embodiment is described with reference to FIGS. 6A to 6D and 7.

FIGS. 6A, 6B, 6C, and 6D are projection views of the dielectric filter; FIG. 6A is a top view of the dielectric filter in a case in which the dielectric filter stands and the mounting face faces forward; FIG. 6B is a front view; FIG. 6C is a left-side view; and FIG. 6D is a bottom view. As is obvious from comparison with FIGS. 3A to 3D, in this dielectric filter, by providing the centers of the holes on the short-circuit end sides of the internal-conductor-formed holes 2*a* and 2*b* relatively close to each other due to the decentralization on the open-end sides, capacitive coupling is generated between the resonators using these two internal-conductor-formed holes. Likewise, capacitive coupling is generated between the two resonators using the internal-conductor-formed holes 2*c* and 2*d*. Capacitive coupling is generated between the resonators using the internal-conductor-formed holes 2*b* and 2*c* by providing the centers of the holes 2*b* and 2*c* on the open-end sides relatively close to each other due to the decentralization on the open-end sides.

The equivalent circuit of this dielectric filter is identical to that shown in FIG. 4. The leap capacitance $C_b$ is provided between the two resonators capacitively coupled.

Figure 7:
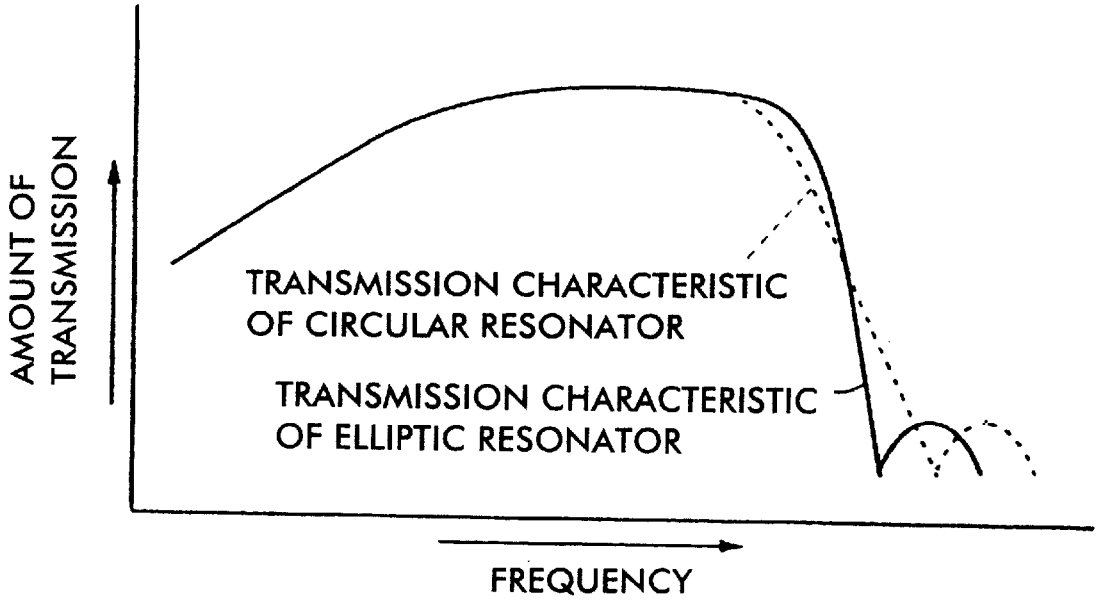
FIG. 7 is a graph showing a transmission characteristic of the dielectric filter.

FIG. 7 shows a transmission characteristic of this dielectric filter. Thus, by providing the leap capacitance between the two resonators capacitively coupled, the attenuation pole is generated on the high-frequency side of the passband. In FIG. 7, the solid line indicates the characteristic of the dielectric filter according to the present embodiment shown in FIGS. 6A to 6D and the dashed line indicates the characteristic in the case in which the internal-conductor-formed holes on the open-end sides have the cross-sectional circular shape in the same manner as those on the short-circuit sides. In the same manner as in the first embodiment, by providing the cross-sectional shapes of the internal-conductor-formed holes on the open-end sides as elliptical shapes extending along a side face of the dielectric block, the attenuation pole can be disposed close to the passband.

Figure 8:
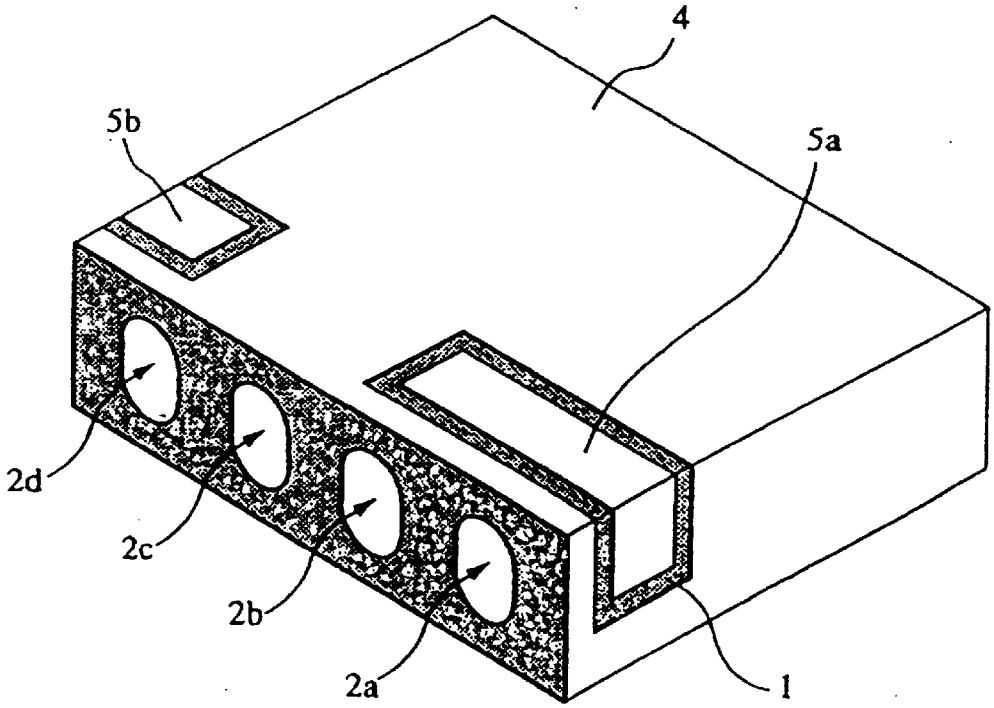
FIG. 8 is a perspective view of a dielectric filter according to a third embodiment.

FIG. 8 is a perspective view of a dielectric filter according to a third embodiment. Although, in the first and second embodiments, the external conductors are formed on the external faces (six faces) and the open ends are provided inside the internal-conductor-formed holes, openings of the internal-conductor-formed holes may be provided as an open-end face as shown in FIG. 8.

The construction of a dielectric duplexer according to a fourth embodiment is described with reference to FIGS. 9 to 11.

Figure 9:
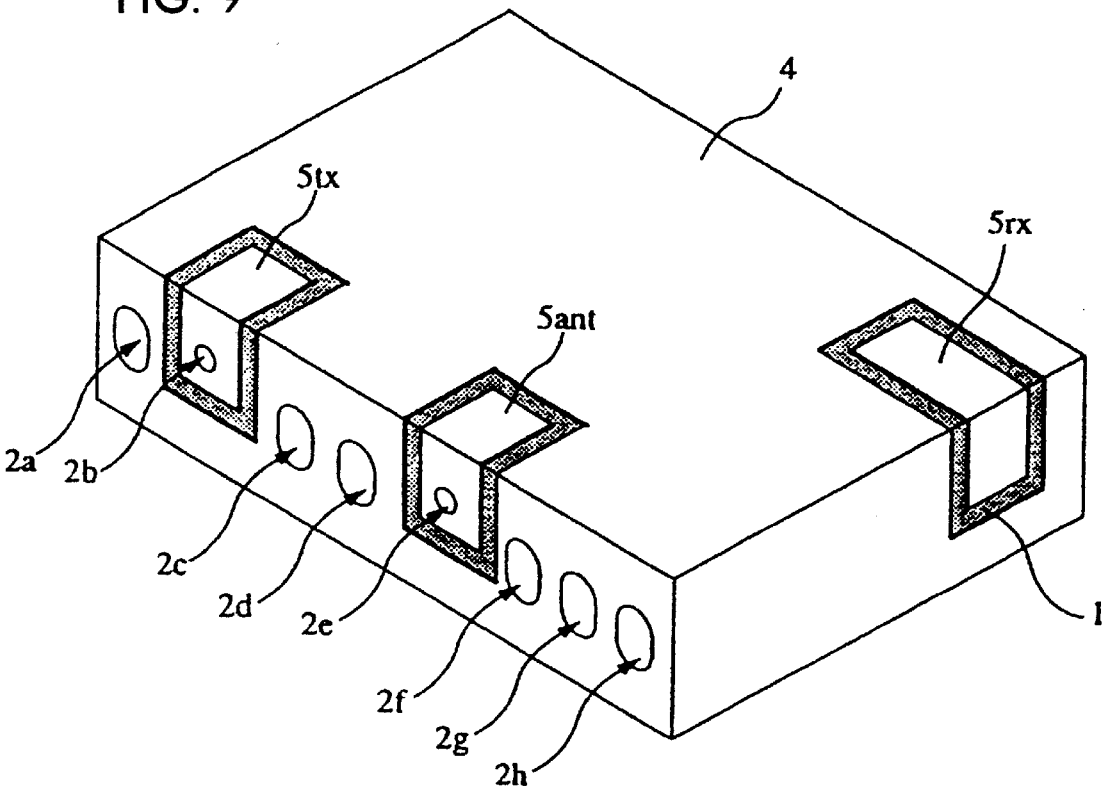
FIG. 9 is a perspective view of a dielectric duplexer according to a fourth embodiment.
Figure 10A:
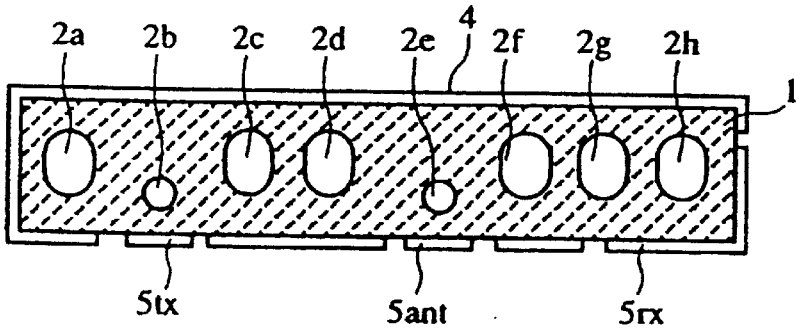
FIGS. 10A and 10B are cross-sectional views of the dielectric duplexer and its comparison example, respectively.
Figure 10B:
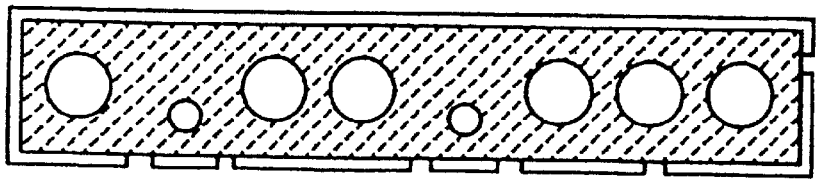

FIG. 9 is a perspective view of the dielectric duplexer. The mounting face of the dielectric duplexer for the mounting substrate is shown as the top face. FIG. 10A is a cross sectional view of primary components of the dielectric duplexer at a face running perpendicular to the axes of the internal-conductor-formed holes. FIG. 10B is a cross sectional view in a comparison example in which the cross sections of the internal-conductor-formed holes are circular. FIG. 11 shows transmission characteristics between an antenna terminal and a reception-signal output terminal of this dielectric duplexer.

As shown in FIG. 9, internal-conductor-formed holes 2*a* to 2*h*, which run parallel to one another, are provided in the rectangular parallelepiped dielectric block 1. The internal conductor is formed in each of these internal-conductor-formed holes. In the same manner as shown in FIG. 1, internal-conductor-non-formed parts (not shown) are provided near the right-rear ends of the internal-conductor-formed holes 2*a*, 2*c*, 2*d*, 2*f*, 2*g*, and 2*h* as viewed in this figure, and these units are disposed as open-ends of the internal conductors. The internal conductors are formed on the entire internal surfaces of the internal-conductor-formed holes 2*b* and 2*e*. An input/output electrode $\mathbf{5}_{rx}$ capacitively coupled between near the open-ends of the internal-conductor-formed holes 2*g* and 2*h*, input/output electrodes $\mathbf{5}_{tx}$ and $\mathbf{5}_{ant}$ in electrical continuity with ends of the internal-conductor-formed holes 2*b* and 2*e*, respectively, and the external conductor 4 are formed on the external surfaces (six faces) of the dielectric block 1.

The resonator using the internal-conductor-formed hole 2*a* is interdigitally-coupled with the resonator using the internal-conductor-formed hole 2*b* to act as a trap filter. The two resonators using the internal-conductor-formed holes 2*c* and 2*d* are comb-line coupled, and the resonator using the internal-conductor-formed hole 2*c* and the internal conductor of the internal-conductor-formed hole 2*b*, acting as an excitation line, are interdigitally-coupled. Likewise, the resonator using the internal-conductor-formed hole 2*d* is interdigital-coupled with the internal conductor of the internal-conductor-formed hole 2*e*. The resonators using the internal-conductor-formed holes 2*f*, 2*g*, and 2*h* are comb-line coupled. The resonator using the internal-conductor-formed hole 2*f* and the internal conductor of the internal-conductor-formed hole 2*e* are interdigital-coupled.

The resonators using the internal-conductor-formed holes 2*a*, 2*c*, and 2*d* act as transmission filters and the resonators using the internal-conductor-formed holes 2*f*, 2*g*, and 2*h* act as reception filters. The input/output electrodes $\mathbf{5}_{tx}$, $\mathbf{5}_{ant}$ and $\mathbf{5}_{rx}$ act as a transmission signal input terminal, an antenna terminal, and a reception signal output terminal, respectively.

Figure 11:
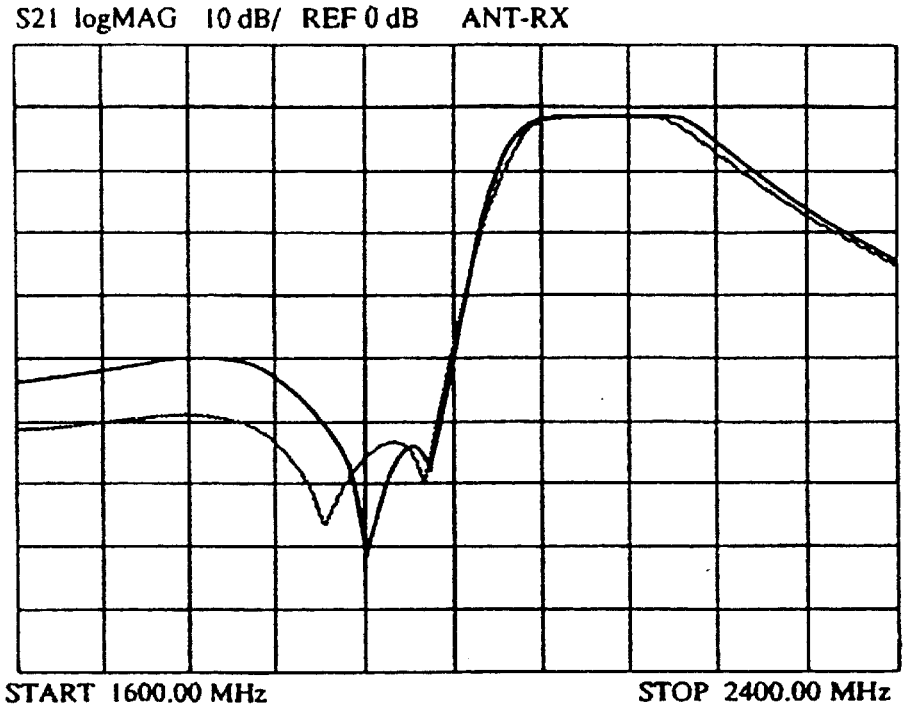
FIG. 11 is a graph showing a transmission characteristic of a reception filter unit of the dielectric duplexer.

Since the input/output electrode $\mathbf{5}_{rx}$, which is the reception signal output terminal, is capacitively coupled with each of the proximities of the open-ends of the internal conductors of the two internal-conductor-formed holes 2*g* and 2*h* which are capacitively coupled, the attenuation pole is generated on the low-frequency side of the passband, as shown in FIG. 11.

When, as shown in FIG. 10B, the cross section on the open-end side of each of the internal-conductor-formed holes is circular and the internal diameter of each of the internal-conductor-formed holes is 1.0 mm, the overall width of the dielectric block is 12.8 mm. According to this embodiment, by causing the internal areas on the open-end sides of the internal-conductor-formed holes to be identical, providing the cross sectional shapes of the internal areas on the open-end sides as ellipses extending perpendicular to the arrangement order of the internal-conductor-formed holes, and setting the widths of the minor axes of the ellipses to be 0.8 mm, the overall width of the dielectric block can be miniaturized up to 11.6 mm.

Figure 12:
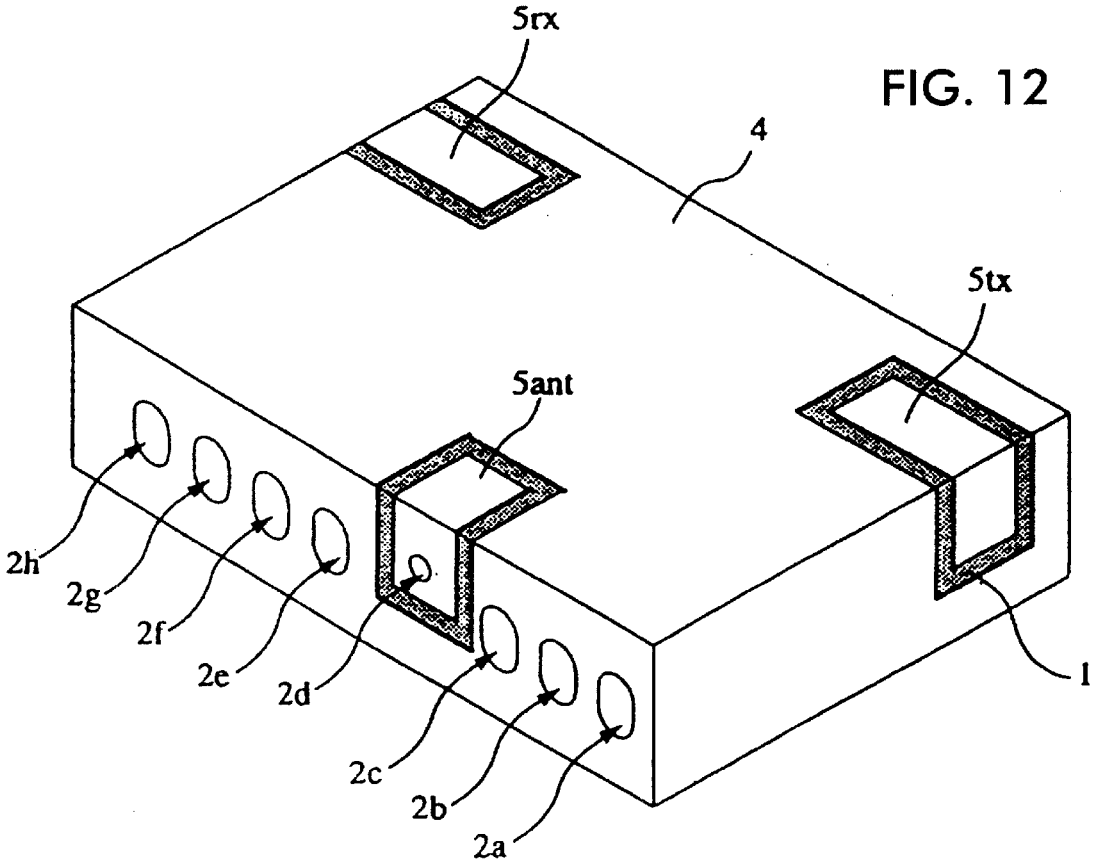
FIG. 12 is a perspective view of a dielectric duplexer according to a fifth embodiment.

FIG. 12 is a perspective views showing the construction of a dielectric duplexer according to a fifth embodiment. The embodiment shown in FIG. 9 causes the reception signal output terminal $\mathbf{5}_{rx}$ to generate the attenuation pole on the low-frequency side of the reception band. In the embodiment shown in FIG. 12, by generating capacitances between the transmission signal input terminal $\mathbf{5}_{tx}$ and each of the proximities of the open-ends of the internal conductors of the two internal-conductor-formed holes 2*a* and 2*b*, the attenuation pole is also generated on the high-frequency side of the transmission band. That is, by capacitive coupling between the resonators using the internal-conductor-formed holes 2*g* and 2*h*, the attenuation pole is generated on the low-frequency side of the passband in the same manner as in the first embodiment. By capacitive coupling between the resonators using the internal-conductor-formed holes 2*a* and 2*b*, the attenuation pole is generated on the high-frequency side of the passband in the same manner as in the second embodiment.

These two attenuation poles of the transmission filter and the reception filter can prevent a transmission signal from being interfered with the reception circuit side.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric filter comprising:

a dielectric block;

a plurality of conductive through holes provided in said dielectric block;

an external conductor formed on an external surface of said dielectric block; and an input/output electrode formed on the external surface of said dielectric block, wherein:

said input/output electrode has a first portion formed on a first face of said dielectric block and a second portion formed on a second face which intersects said first face of said dielectric block, a capacitance is generated between said first portion of said input/output electrode on said first face of said dielectric block and a first conductive through hole of said plurality of conductive through holes closest to said first face, and a capacitance is generated between said second portion of said input/output electrode on said second face and a second conductive through hole of said plurality of conductive through holes adjacent said first conductive through hole.

2. The dielectric filter in accordance with claim 1, wherein said plurality of conductive through holes extend from a front face of said dielectric block to a rear face thereof and the cross section of at least one of said plurality of conductive through holes is a non-circular shape at one of said front and rear faces and is circular in shape at the other of said front and rear faces.

3. The dielectric filter in accordance with claim 2, wherein each of said plurality of conductive through holes has a non-circular shape at one of the front and rear faces and a circular shape at the other of said front and rear faces.

4. The dielectric filter in accordance with claim 3, wherein the non-circular shape is an ellipse.

5. The dielectric filter in accordance with claim 4, wherein a distance between respective centers of said circular shapes of neighboring conductive through holes of said plurality of conductive through holes is smaller than a distance between respective centers of said elliptical shapes of said neighboring conductive through holes.

6. The dielectric filter in accordance with claim 4, wherein a distance between respective centers of said circular shapes of neighboring conductive through holes of said plurality of conductive through holes is greater than a distance between respective centers of said elliptical shapes of said neighboring conductive through holes.

7. A dielectric duplexer comprising a dielectric filter according to claims 1–6, wherein said input/output electrode of said dielectric filter serves as one of a transmission signal input electrode, a reception signal output electrode, and an antenna connection electrode.

8. A communication device comprising the dielectric filter according to claims 1–6.

9. A communication device comprising the dielectric duplexer according to claim 7.

10. The dielectric filter in accordance with claim 1, wherein at least one part of a cross-section of at least one of said plurality of conductive through holes is a non-circular shape.

11. The dielectric filter in accordance with claim 1, wherein at least one of said plurality of conductive through holes is a stepped through hole.

* * * * *